United States Patent [19]

Schultes et al.

[11] 4,320,953

[45] Mar. 23, 1982

[54] PICK-OFF DEVICE FOR ELECTROSTATIC COPIER

[75] Inventors: Max Schultes, Old Tappan, N.J.; Dietmar Eberlein, New City, N.Y.

[73] Assignee: Savin Corporation, Valhalla, N.Y.

[21] Appl. No.: 93,863

[22] Filed: Nov. 13, 1979

Related U.S. Application Data

[63] Continuation of Ser. No. 858,246, Dec. 7, 1977, abandoned.

[51] Int. Cl.[3] ..... G03G 15/00; B65H 29/56

[52] U.S. Cl. ..... 355/3 SH; 271/308; 271/DIG. 2

[58] Field of Search ..... 271/308, 307, 311, DIG. 2, 271/176; 355/3 SH; 118/60, 245; 432/60; 34/120; 100/174

[56] References Cited

U.S. PATENT DOCUMENTS

| | | | |
|---|---|---|---|
| 3,046,009 | 7/1962 | Hartel | 271/176 |
| 3,578,859 | 5/1971 | Stillings | 271/DIG. 2 X |
| 3,921,973 | 11/1975 | Kitagawa et al. | 271/286 |
| 4,004,802 | 1/1977 | Brooke | 271/DIG. 2 X |
| 4,065,120 | 12/1977 | Imaizumi et al. | 271/DIG. 2 X |
| 4,269,504 | 5/1981 | Landa | 271/308 X |

*Primary Examiner*—Bruce H. Stoner, Jr.
*Attorney, Agent, or Firm*—Shenier & O'Connor

[57] ABSTRACT

An improved pick-off device for a copying machine of the type in which the developed image is transferred from the surface of a photoconductor to a sheet of copy paper in which a thin semi-rigid blade having a knife edge at a transversely tapered end thereof is releasably secured to a resiliently restrained element of a clutch assembly mounted at a position at which the knife edge of the blade is resiliently biased into engagement with the photoconductor at a location in the path of the leading edge of a sheet to which an image has been transferred to guide the sheet into a narrow space between the normally stationary clutch element and a continuously driven clutch element. In response to the entry of the sheet into the narrow space the two clutch elements are coupled to cause the restrained element to move with the continuously driven element against the action of the restraining means to carry the sheet away from the photoconductor surface. After a predetermined concomitant rotation of the clutch elements as the leading edge of the copy sheet enters the nip between an upper delivery roller and a lower delivery roller which moves with the continuously driven clutch element, the normally restrained clutch element is advanced relatively to the continuously driven clutch element to release the sheet and to restore the knife edge precisely to its initial position.

22 Claims, 6 Drawing Figures

Fig 1
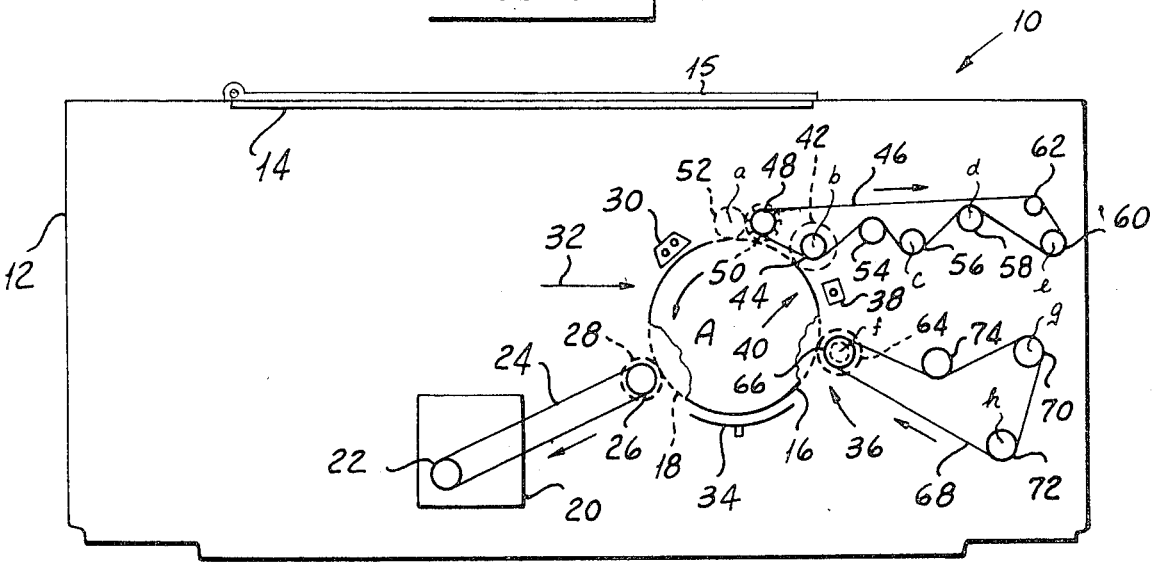
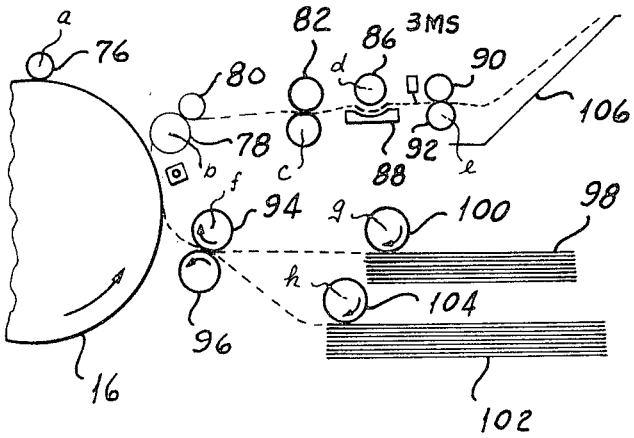
Fig 2

PICK-OFF DEVICE FOR ELECTROSTATIC COPIER

This application is a continuation of application Ser. No. 858,246, filed Dec. 7, 1977, now abandoned.

BACKGROUND OF THE INVENTION

These are known in the prior art plain paper electrostatic copying machines in which a drum carries a surface coating of photoconductive material, such for example as selenium. In operation of such a machine the surface of the drum is moved successively past the charging station at which a corona applies a uniform electrostatic charge over the surface of the drum and then to an exposure station at which the charged surface is exposed to an image of the original to be copied. At this station, the surface of the drum over relatively light areas of the image to be copied loses its charge while retaining its charge in relatively darker areas of the original, thus to produce a latent electrostatic image of the original to be copied.

Following the exposure station, the surface is carried through a developer station at which the latent image is subjected to the action of the developer including toner particles which adhere to the charged areas of the image, thus to develop the image. As the surface carrying the developed image leaves the developer station, it moves past a point at which a length of copy material, such as ordinary paper to which the image is to be transferred is fed to the drum so as to be carried along with the drum beneath a transfer corona. This transfer corona causes the particles of toner to migrate from the surface of the photoconductor to the surface of the copy sheet.

After the image has thus been transferred to the length of copy material, it is necessary to remove the sheet from the surface of the photoconductor which may, for example, be on a drum. In one particular arrangement employed to pick off a copy sheet carrying a developed image in a machine of the type described above, a stationary flexible band conforming to the configuration of the drum over a portion of the circumference thereof from the location at which copy material is fed to the drum to a location beyond the transfer corona is mounted at the edge of the drum, so that a narrow strip of copy material extending along a side thereof moves over the stationary flexible band as the length of copy material moves under the transfer corona. At the point at which the copy material is to be removed from the surface of the drum, a struck up portion of the flexible strip moves a leading corner of the length of copy material away from the drum and into the nip between a turn roll and a rubber belt, a portion of the length of which extends around and into contact with the surface of the turn roll. The turn roll is driven in cooperation with the belt to carry the developed sheet away from the photoconductive drum toward conveyor rollers which deliver the sheet to the user of the machine. This pick-off arrangement is illustrated in and is more fully described in Ariyama U.S. Pat. No. 3,936,045, for "Sheet Stripping Device for Copying Apparatus".

After the photoconductive surface leaves the pick-off station described hereinabove, it next moves through a cleaning station at which a sponge roller in engagement with the surface of the drum is driven in such a direction that the engaging surface portions of the roller and the drum move in opposite directions. This sponge roller normally is wet with developer to facilitate the cleaning action and to prevent scratching of the drum surface by toner particles which remain on the roller when the developer dries.

While the machine described above functions satisfactorily in most instances, it incorporates a number of serious disadvantages. First, it will readily be apparent from the description of the pick-off system described hereinabove, that the copy sheet can have no image transferred thereto over the space along the edge thereof which rides over the flexible band extending through the transfer station. Thus, where the original carries information or printing in this area, it will not appear on the copy. Attempts to obviate this problem by minor modifications for directing the corner of the sheet into the nip between the turn roller and the belt without the use of a strip extending through the transfer station have not proved successful since any developed image in the strip which formerly was blank became smeared or dirtied.

Landa Application Ser. No. 850,216, filed Nov. 9, 1977, now abandoned and replaced by continuation application Ser. No. 060,537 filed July 25, 1979, now U.S. Pat. No. 4,269,504, shows a pick-off system which overcomes the defects of the pick-off system described hereinabove. More specifically, Landa discloses a clutch assembly including a first continuously rotating element and a second element including a finger disposed in closely spaced relationship to the outer surface of the first member and restrained against rotation with the first element by a follower resiliently urged into engagement with a cam on the first member. The clutch assembly is mounted with the mouth of the narrow space closely adjacent to the surface of the photoconductor at a location beyond the transfer station of the machine. Means is provided for guiding the leading edge of the sheet into the mouth of the opening so that the clutch elements move together against the action of the cam follower biasing means to carry the leading edge of the sheet into the nip between a pair of delivery rolls. At that point the cam and follower under the action of the follower biasing means coact to release the clutch and to restore the second clutch element to its initial position. The Landa application suggests a number of specific devices for guiding the leading edge of a sheet of paper from the surface of the photoconductor into the mouth of the space between the two clutch elements. First, the application discloses a shoe pivoted on the machine frame and resting on the photoconductor surface at a location at which it intercepts the leading edge of the sheet. Secondly, the application discloses means for forming a crimp in the sheet so that the leading edge automatically enters into the mouth. A third device suggested in the application is an air jet directed toward the surface so as to lift the leading edge off the surface and into the mouth of the clutch space. While it is possible to direct the leading edge of the sheet into the clutch mouth by any of the means set forth in the Landa application none of these means are as certain in operation as is desirable. That is, while any of the means will operate for a certain period of time without failure, the occasions on which they fail to operate, resulting in paper jams, are too frequent.

SUMMARY OF THE INVENTION

One object of our invention is to provide an improved pick-off for a copying machine which overcomes the defects of pick-off systems of the prior art.

Another object of our invention is to provide an improved pick-off device for a copying machine which permits substantially the entire area of the copy sheet to receive a transferred image.

Still another object of our invention is to provide an improved pick-off device for a copying machine which is reliable in operation.

A still further object of our invention is to provide an improved pick-off device for a copying machine which prevents a double fed sheet from wrapping around the cleaning roller of the machine.

Other and further objects of my invention will appear in the following description.

BRIEF DESCRIPTION OF THE DRAWINGS

In the accompanying drawings which form part of the instant specification and which are to be read in conjunction therewith and in which like reference numerals are used to indicate like parts of the various views:

FIG. 1 is a simplified schematic view of the drive system of an electrostatic copying machine incorporating our improved pick-off device with parts of the machine removed.

FIG. 2 is a diagrammatic view of the copy paper handling system of the electrostatic copier illustrated in FIG. 1.

FIG. 3 is a fragmentary sectional view of the copying machine illustrated in FIGS. 1 and 2 and showing our improved pick-off device.

DESCRIPTION OF THE PREFERRED EMBODIMENT

Figures 4, 5:
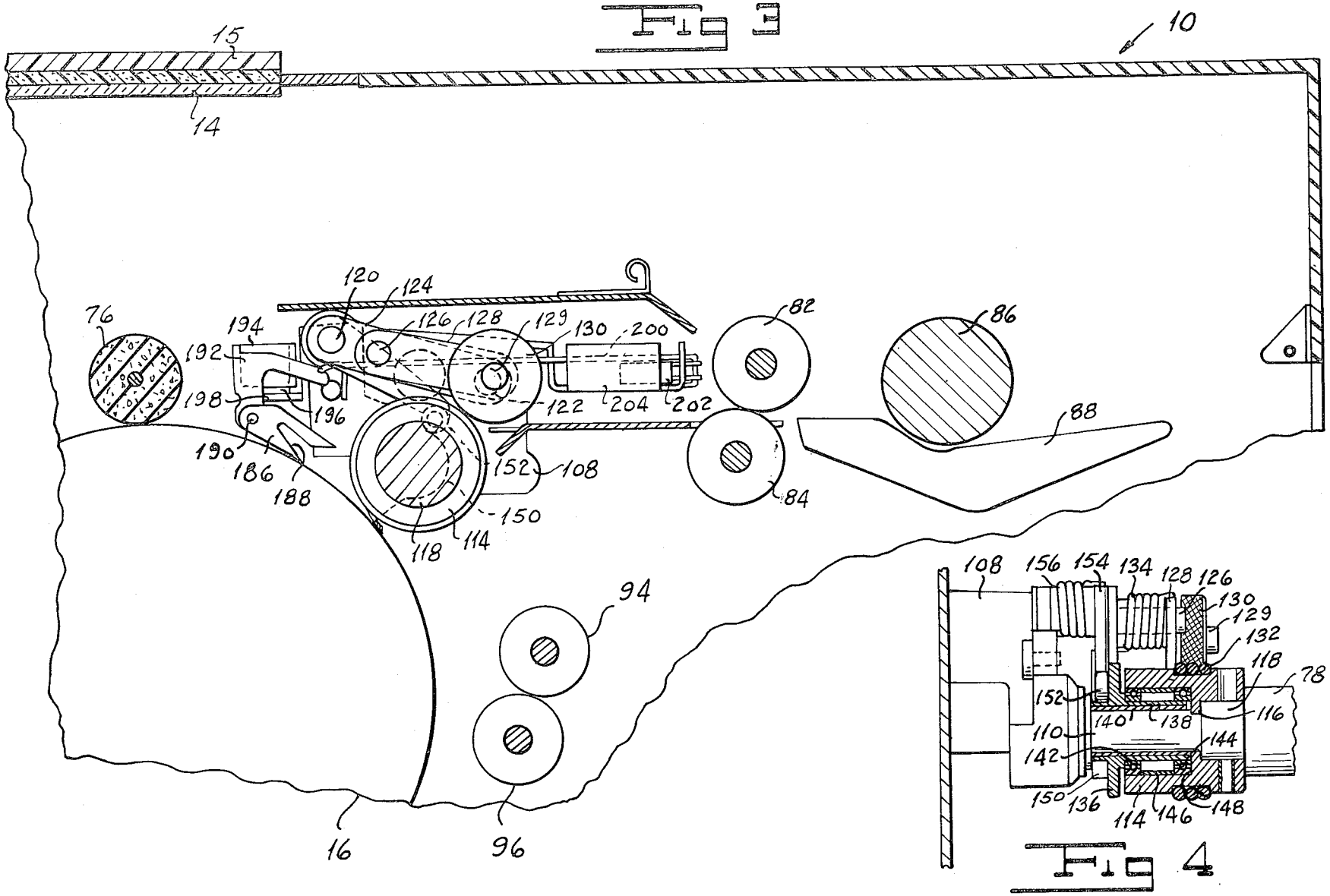
FIG. 4 is a fragmentary view with parts in section illustrating our improved pick-off device for copying machines.
FIG. 5 is a fragmentary elevation of our improved pick-off device for copying machines.

Referring now to FIGS. 1 and 2 of the drawings, a machine indicated generally by the reference character 10 with which our improved pick-off device is used includes a cabinet 12, a top of which is provided with a transparent platen 14, normally covered by a cover 15 hinged to the cabinet. The cover can be moved away from the platen to permit an original to be placed face down to the platen. A drum 16 carrying a suitable photoconductor on the surface thereof is rotatably supported for movement in the cabinet 10 by any suitable means known to the art. In the schematic view in FIG. 1, for purposes of simplicity, we have illustrated gears in broken lines and have indicated sprocket wheels in full lines. A gear 18 which rotates with the drum 16 is adapted to be driven to rotate the drum in the direction of the arrow A in FIG. 1. Machine 10 includes a prime mover 20, the output shaft of which carries a sprocket wheel 22 adapted to drive a pitch chain 24 to drive a sprocket wheel 26. Chain 24 moves in the direction of the arrow adjacent to the chain so that a gear 28 mounted on the shaft of sprocket wheel 26 for rotation therewith drives gear 18 to rotate the drum 16 in the direction of the arrow A.

Further, as is known in the art, as the drum 16 rotates in the direction of the arrow A, its surface moves successively past a corona 30, which is activated to produce a uniform electrostatic charge on the surface of the drum. After leaving the corona 30, the surface passes by an exposure station indicated by the arrow 32 at which a moving optical system scans the original which has been placed face down on platen 14 so as to translate a line image of the original to the surface of the moving drum 16. Since the details of the optical system, per se, form no part of our invention, they have not been shown in the drawings.

After leaving the exposure station 32, the surface of the drum moves through a developer unit 34 at which the latent electrostatic image thereon is subjected to the action of a liquid developer containing particles of toner which adhere to those areas of the drum surface which have retained their charge after exposure to the image. As the developed latent image moves further in the direction of the arrow A, a sheet of plain paper is fed to the drum at a station indicated generally by the reference character 36. The paper moves with the drum past a transfer corona 38 which is energized to cause the developed image to migrate from the surface of the drum to the underside of the paper. After transfer has thus been effected, the sheet carrying the developed and transferred image is to be carried away from the drum at a pick-off station indicated generally by the reference character 40.

A gear 42 which meshes with the drum gear 18 provides the input to the copy pick-off and delivery system. Gear 42 is on a shaft which is common with a sprocket wheel 44 so that gear 42 and sprocket wheel 44 rotate around an axis "b" which is the axis of the take-off roll to be described more fully hereinbelow. Sprocket wheel 44 drives pitch chain 46 in the direction of the arrow adjacent to the chain in FIG. 1. Chain 46 in turn drives a sprocket wheel 48, the shaft of which also carries a gear 50 which meshes with a gear 52 to drive gear 52 in a counterclockwise direction around the axis "a" of the cleaner roll to be described in detail hereinbelow.

Chain 46 also engages a tensioning sprocket wheel 54 and a sprocket wheel 56 mounted for rotation around the axis "c" of the lower of a pair of take-off rolls to be described hereinbelow. A hold-down roller sprocket wheel 58 is engaged by chain 46 so as to be driven in counterclockwise direction around the axis "d". Finally, the pitch chain 46 also drives a lower delivery roll sprocket wheel 60 mounted for movement around an axis "e". An idler sprocket wheel 62 completes the path of the chain back to sprocket wheel 48.

The drive system for the copy paper supply assembly includes a gear 64 adapted to be driven by the drum gear 18. A sprocket wheel 66 on a shaft common to the gear 64 is driven around an axis "f" to drive a pitch chain 68 in the direction of the arrow adjacent to the chain in FIG. 1. Chain 68 drives respective upper and lower paper supply roll sprocket wheels 70 and 72 mounted for movement around respective axes "g" and "h". A tensioning sprocket wheel 74 is arranged to give sufficient tension to the chain 68. All of the gear, sprocket wheel and pitch chain mechanism just described is located at the rear of the machine 10.

As can be seen by reference to FIG. 2, a spongy cleaner roll 76 mounted for movement around the axis "a" is driven by gear 52 so that the surface of the cleaning roll in engagement with the drum moves in a direction opposite to the direction of movement of the drum surface.

A take-off roll 78, more fully to be described hereinafter, cooperates with a roller 80 to deliver a picked off sheet to the nip between a pair of intermediate conveyor rolls 82 and 84, the roll 84 of which is mounted for movement around the axis "c". After leaving the rolls 82 and 84, the sheet passes between a hold-down roller 86 mounted for movement around the axis "d" so as to be brought into operative relationship with a dryer 88. As the sheet leaves the dryer 88, it enters the nip between delivery rolls 90 and 92, the lower roll 92 of which is mounted for movement around the axis "e". These rolls pass the copy to a tray 106, or the like.

The machine with which our improved pick-off is used includes two cassettes holding respective supplies 98 and 102 of paper of different sizes. Respective paper feeding rolls 100 and 104 associated with the supplies 98 and 102 are mounted for movement at the axes "g" and "h". Means (not shown) under the control of the operator is adapted to be actuated selectively to bring one or the other of the supplies 98 or 102 into cooperative relationship with its associated roller 100 or 104. The operative roller delivers a sheet to the nip between a pair of feed rolls 94 and 96, the upper one of which is mounted for movement at the axis "f". Rolls 94 and 96 deliver the fed sheet to the surface of the drum 16. The structure thus far described is that of a machine to which our improved pick-off device is applied.

Figure 6:
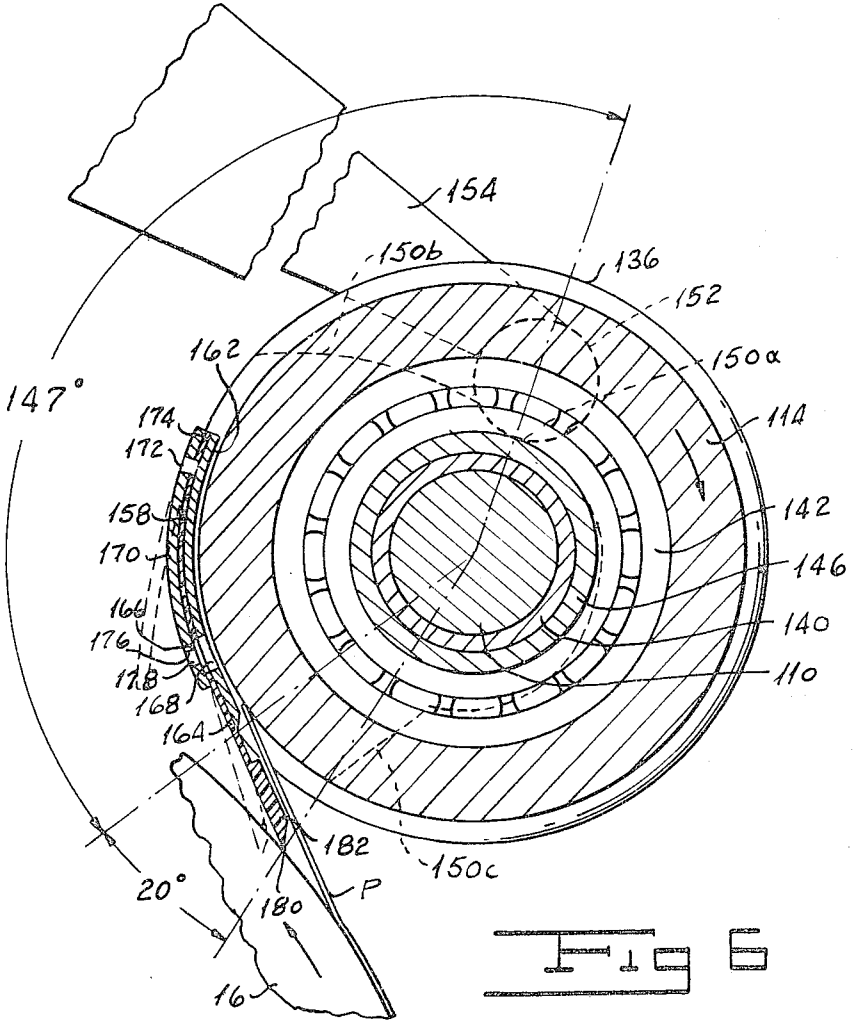
FIG. 6 is a fragmentary sectional view of our improved pick-off device for copying machines.
Figure 5:
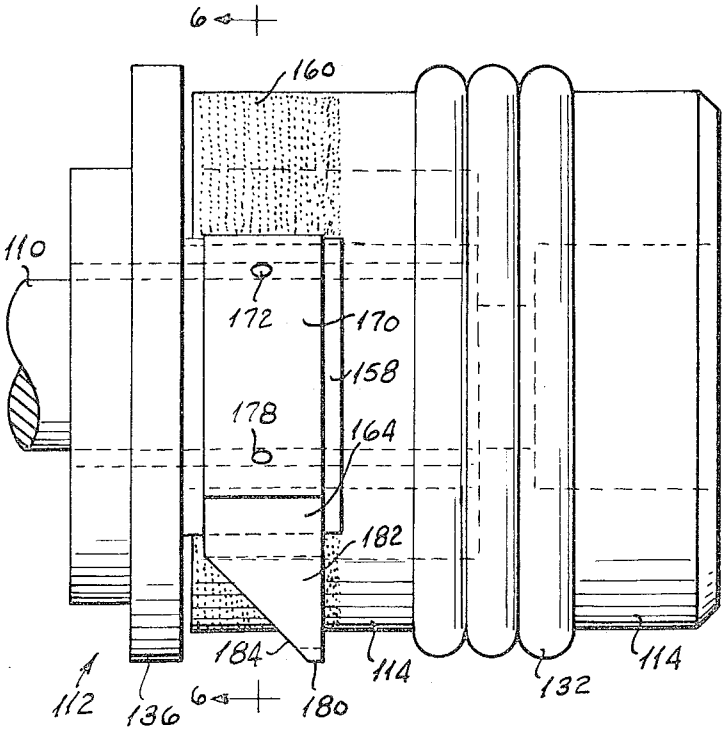

Referring now to FIGS. 3 to 6, gear 42, which is disposed in a housing 108 carried by a side of the machine, drives a shaft 110 extending out of the housing 108. The clutch assembly indicated generally by the reference character 112 which forms a part of our improved pick-off, includes a driver member 114, which is keyed to the shaft 110 by a key 116. This key 116 is so arranged as to permit some radial movement of the clutch member 114 with reference to the shaft 110 for accurate positioning relative to the shaft in a manner to be described hereinbelow. Member 114 further is adapted to receive a reduced end portion 118 of turn roller 78, the arrangement being such that when the reduced end portion 118 is inserted into the member 114 roll 78 rotates with the member 114.

Housing 108 carries respective outwardly extending studs 120 and 122 which receive a bracket 124 secured to the studs by any suitable means known to the art. A pin 126 carried by the bracket 124 intermediate its ends pivotally supports an arm 128, the end of which carries a shaft 129 which rotatably supports a metal roller 130 having a knurled outer surface. A spring 134 wrapped around the pin 126 bears with one end adjacent the bracket 124 and with the other end against the arm 128, so as to resiliently urge the roller 130 into engagement with rubber rings 132 carried by clutch member 114.

The other clutch member 136 includes a disk-like portion on an integral axially extending hub portion 138 carried by a bushing 140 supported on the shaft 110. Respective ball bearings 142 and 144, the inner rings of which are received on the hub 138 are held in spaced relationship by a spacer 146 located between the outer rings of the bearings. These bearings 142 and 144 are received in a recess 148 formed in the clutch member 114. Bearings 142 and 144 accurately space clutch member 114 in a radial direction with reference to the hub 138 of the clutch member 136. As has been pointed out hereinabove, the key 116 permits some radial movement of the clutch member 114 relative to the shaft 110, thus to permit the bearings 142 and 144 to perform the function of accurately positioning the member 114 radially with reference to the hub 138 of the member 136.

From the structure thus far described, it will readily be apparent that shaft 110 continuously drives the member 114 owing to the connection therebetween provided by the key 116. Moreover, under the action of friction, member 136 likewise would tend to rotate with the shaft 110. The clutch assembly is provided with means for normally restraining member 136 against rotation with the shaft 110. Clutch 136 is formed with a cam 150 having a low point 150*a* followed by a rising portion 150*b* in the counterclockwise direction as viewed in FIG. 6 and then a relatively sharp drop 150*c*. Stud 120 rotatably supports a follower arm 154 carrying a follower 152 adapted to ride against the cam 150. A spring 156 on the stud 120 normally urges the arm 154 to rotate in a clockwise direction as viewed in the drawings. In the inactive condition of the parts, follower 152 rests against the low point 150*a* of the cam. In this condition the action of spring 156 on the arm 154 overcomes the frictional tendency of the clutch member 136 to rotate with clutch member 114, so that the clutch member 136 is stationary.

The disk-like portion of clutch member 136 is formed with a peripheral axially extending finger 158 which extends for a predetermined distance around the disk-like portion of member 136. It will be seen that finger 158 forms a narrow radial gap with member 114. The radial extent of the gap is accurately determined by the bearings 142 and 144. In practice the spacing between the finger 158 and the member 114 may be of the order of two mils. We provide a roughened surface portion 160 on the outer surface of member 114 below the finger 115 and highly polish the inner surface 162 of the member 158. As will more fully be explained hereinbelow, in operation of the clutch the surface 162 cooperates with the image bearing side of the copy sheet, while the surface 160 cooperates with the reverse side of the copy sheet. The space between the finger 158 and the member 114 is such that introduction of the leading edge of a sheet of common copy paper into the space between the finger and the member will clutch the finger and the member together with sufficient force to overcome the influence of spring 156 to cause the two members to move together. Moreover, as the two members move together, follower 152 rides up the rise 150*b*, thus to increase the force with which the leading edge of the paper is gripped. As the paper is thus carried around with the two clutch elements in a clockwise direction as viewed in the drawings, ultimately the sharp drop 150*c* in the surface of cam 150 will arrive at the location of the follower 152. As the follower 152 moved up the rise 150*b*, the force stored in the spring 156 increases. Thus, when the drop 150*c* arrives at the follower 152, the spring 156 rapidly moves clutch member 136 and finger 158 carried thereby in a clockwise direction but more rapidly than the speed of rotation of member 114, thus to release the portion of the leading edge of the copy which has been gripped by the clutch mechanism. It will readily be appreciated that the highly polished inner surface of finger 158 facilitates this releasing operation. At the time of this releasing operation, the leading edge of the paper has already moved into the nip between the knurled roller 130 and the rubber rings 132. From this point, the copy paper is carried out of the machine by means of the delivery rolls 82 and 84. It is to be emphasized that under the action of the cam and follower, finger 158 is brought precisely back to the same location on each operation of the machine.

Our improved pick-off device includes a blade 164 formed of a suitable material which will not result in excessive wear on the photoconductor. We may, for example, form the blade 164 from polytetrafluoroethylene copolymer or polyethylene terephthalate copolymer. An opening 166 in the blade 164 receives a post or pin 168 carried by the finger 158 of the normally stationary clutch element. We secure an arcuate resilient retainer 170 to the finger 158 by means of a rivet 172 or the like which passes through a spacer 174 between the retainer 170 and finger 158. A hole 176 in the retainer 170 receives an extension 178 on pin 168. It will readily be appreciated that the retainer 170 releasably holds the blade 164 in position on finger 158. The blade 164 can readily be removed and replaced by moving the retainer 170 to the broken line position shown in FIG. 6.

Preferably, we form the lower part of the finger 164 as viewed in the drawings with a thickened portion 182 which obviates the danger of the leading edge of a sheet being directed toward the location at which the lower end of finger 158 as viewed in the drawings engages blade 164. It will readily be appreciated that the occurrence of the event which is obviated by thickened portion 182 could easily result in a jam.

Thickened portion 182 terminates in a knife edge 180 adapted to engage the photoconductor drum surface. We provide the lower end of the blade 164 with a lateral taper 184 to minimize the line of contact between the knife edge 180 and the drum 16.

While the material of which our blade 164 is formed is relatively rigid, it is also somewhat resilient. If the pick-off assembly were displaced from the drum the blade 164 would assume the position shown in broken lines in FIG. 6. If the pick-off assembly is restored to its normal position adjacent to the drum, the blade 164 moves to the full line position shown in FIG. 6. It will thus be seen that, in the operative position of the pick-off assembly the blade 164 is biased into engagement with the surface of drum 16 by virtue of the inherent resiliency of the material of which the blade is made.

We provide the copy machine with which our pick-off assembly is used with means for preventing sheets which are not picked off by the pick-off assembly and more particularly second sheets resulting from double feeds from advancing to the cleaning roll 76 and becoming wrapped therearound. A shoe 186 having a recess 188 is carried by a rod 190 supported on an actuator 192 connected to a sleeve 194 received by a vertically extending pin 196 on a bracket 198. When a sheet is not picked off by the pick-off assembly its leading edge enters recess 188 or engages actuator 192 to cause the actuator 192 to rotate around pivot pin 196. When this occurs, a wire 200 carried by the actuator operates a switch 202 carried by a bracket 204. This cause the machine to stop and activate a suitable indicator. The structure and operation of the system outlined above is more fully shown and described in our copending application Ser. No. 805,836, filed June 13, 1977, now abandoned and replaced by continuation application Ser. No. 043,755, filed May 30, 1979, now U.S. Pat. No. 4,244,648.

The operation of our improved pick-off device will readily be understood from the description hereinabove. So long as the drum 16 is being driven, shaft 110 is driven to drive clutch member 114. At the same time, the action of spring 156 prevents rotation of clutch member 136 with the member 114. After an image has been formed on the drum 16 and developed, a sheet of copy material is fed to the drum beneath the transfer corona 38. As the sheet moves past the transfer corona, the developed image migrates from the surface of the drum to the surface of the sheet in contact with the drum. As a sheet which has received the image moves out of the transfer location, its leading edge rides up the thickened portion 182 of blade 164 and is directed into the space between finger 158 and member 114. The thickened portion 182 directs the leading edge of the sheet away from the line of contact between the lower end of finger 158 and blade 164. Owing to the relationship of the thickness of the sheet 168 to the space between finger 158 and member 114, as the leading edge of the sheet enters the space, the finger 158 and member 114 are clutched together to overcome the force of spring 156 and to cause the follower 152 to ride up the cam rise **150*b*. As this occurs, the spring is loaded to increase the force with which the leading edge of the paper is grasped between the finger 158 and the member 114. After a predetermined rotation of member 114 to a location at which the leading edge of the paper has moved into the nip between roller 130 and rings 132, the cam drop 150*c* has arrived at the location of follower 152. At this point the force of the loaded spring 156 moves the member 136 and finger 158 in the same direction and at a greater speed than the member 114 to release the leading edge of the sheet. As has been pointed out hereinabove, the highly polished surface 162 of finger 158 facilitates this releasing action. At the end of the operation knife edge 180** returns to precisely the same position it occupied at the beginning.

It addition to the foregoing, if by any chance a double feed occurs, the second sheet will be intercepted by shoe 186 or actuator 192, the machine will stop and the user will be informed of the malfunction.

It will be seen that we have accomplished the objects of our invention. We have provided a pick-off for a copying machine which overcomes the defects of pick-off systems of the prior art. Our pick-off device permits substantially the entire area of the copy sheet to receive a transferred image. Our pick-off device is reliable in operation. Our pick-off arrangement incorporates means for preventing a double fed sheet from becoming wrapped around the cleaning roller of the machine. Our device successfully picks a copy sheet off the drum and delivers it to the customer without smudging any part of the formed image and without dirtying the copy. It is extremely reliable in operation.

It will be understood that certain features and subcombinations are of utility and may be employed without reference to other features and subcombinations. This is contemplated by and is within the scope of our claims. It understood that our invention is not to be limited to the specific details shown and described.

Having thus described our invention, what we claim is:

1. In a copying machine of the image transfer type in which an image developed on a surface is transferred to a sheet of copy material which moves with the surface through a transfer station to a pick-off station, pick-off apparatus including a first clutch element, means for driving said first clutch element, a second clutch element, means mounting said second clutch element for movement relative to said first clutch element with a narrow space between said elements, an opening leading into said narrow space, means positioning said clutch elements with said opening at a location adjacent to said surface, means including a blade carried by said second clutch element and for movement therewith, said blade extending generally in a direction opposite to the direction of movement of said first clutch element from said opening to a location at which it engages said moving surface to intercept the leading edge of a copy sheet moving with said surface to strip a portion of said sheet away from said surface and to direct said portion into the space between said elements, the relationship between the thickness of said sheet and the space between said elements being such that entry of said sheet into said space clutches said elements to each other for movement as a unit, and means responsive to a predetermined movement of said elements as a unit for moving said elements relative to each other to free said portion of said copy sheet.

2. Apparatus as in claim 1 including means for biasing said blade into engagement with said surface.

3. Apparatus as in claim 1 in which said blade is formed of low friction material.

4. Apparatus as in claim 1 including means for manually detachably mounting said blade on said second clutch element.

5. Apparatus as in claim 4 in which said mounting means comprises a resilient retainer.

6. Apparatus as in claim 5 in which said mounting means comprises a post on said second clutch element, an opening in said blade for receiving said post and an opening in said retainer for receiving said post.

7. Apparatus as in claim 1 in which said blade is formed with a knife edge at its end in engagement with said surface.

8. Apparatus as in claim 7 in which said blade is tapered in the direction of its width adjacent to said knife edge.

9. In a copying machine of of the image transfer type in which an image developed on a surface is transferred to a sheet of copy material which moves with the surface through a transfer station to a pick-off station, pick-off apparatus including a first generally cylindrical clutch element, means for rotating said first clutch element, a second clutch element comprising an arcuate finger, means mounting said second clutch element for rotary movement relative to said first clutch element and with said finger in closely spaced relationship to said first clutch element to form a narrow space between said finger and said first clutch element with a mouth adjacent to said surface opening into said space, resilient means normally restraining said second clutch element against movement with said first clutch element, a blade carried by said finger for movement therewith, said blade extending generally in a direction opposite to the direction of rotation of said first clutch element from said opening to a location at which it engages said moving surface when said second element is restrained against movement with said first element to intercept the leading edge of a copy sheet moving with said surface to strip a portion of said sheet away from said surface and to direct said portion into said mouth, the relationship between the thickness of said sheet and the narrowness of said space being such that entry of said sheet into said space clutches said elements to each other to overcome said resilient means to cause said elements to rotate as a unit, and means responsive to a predetermined rotation of said elements as a unit for moving said elements relative to each other to free said portion of said sheet.

10. Apparatus as in claim 9 including means for biasing said finger into engagement with said surface.

11. Apparatus as in claim 9 including means for manually releasably mounting said blade on said finger.

12. Apparatus as in claim 11 in which said mounting means comprises a post on said finger, an opening in said blade for receiving said post and a resilient retainer secured to said finger and overlying a portion of said blade.

13. Apparatus as in claim 12 including an opening in said retainer for receiving said post.

14. Apparatus as in claim 9 in which said blade overlies said finger and extends beyond the end of said finger to said surface and in which said blade is formed with a thickened portion adjacent to said surface for directing the leading edge of a sheet away from the point at which said blade leaves the end of said finger.

15. Apparatus as in claim 9 in which said blade is formed with a lateral taper adjacent to said surface to minimize the contact between said blade and said surface.

16. Apparatus as in claim 9 in which said blade is formed with a knife edge which engages said surface in the restrained position of said first clutch element.

17. Apparatus as in claim 9 in which said blade is formed from a low friction synthetic resin.

18. Apparatus as in claim 9 in which said blade is formed with a knife edge at the end thereof remote from said finger, means mounting said blade on the outer surface of said finger such that a portion of said blade extends tangentially from said finger in a first position when said second clutch element is out of its restrained position, said knife edge engaging said surface in the restrained position of the second clutch element to move said portion of said blade to a second position in close conformity to the outer surface of said finger whereby said knife edge is biased into engagement with said surface.

19. Apparatus as in claim 18 in which said mounting means comprises an arcuate retainer overlying a second portion of said blade other than said first-named portion and means for securing said retainer to said finger.

20. Apparatus as in claim 19 in which said mounting means comprises a post on said finger, said second portion of said blade formed with an opening for receiving said post, said retainer being resilient to permit the portion thereof overlying said second blade portion to be moved manually away from said finger to permit said blade to be removed from said post.

21. Apparatus as in claim 18 in which said blade is formed with a thickened portion adjacent said knife edge to direct the leading edge of a sheet away from the location at which said first-named blade portion engages the end of said finger in the second position thereof.

22. In a copying machine of the image transfer type in which an image developed on a surface is transferred to a sheet of copy material which moves with the surface through a transfer station to a pick-off station, pick-off apparatus including a first clutch element, means for driving said first clutch element, a second clutch element, means mounting said second clutch element for movement relative to said first clutch element with a narrow space between said elements, an opening leading into said narrow space, means positioning said clutch elements with said opening at a location adjacent to said surface, means including a blade carried by said second clutch element and for movement therewith, said blade extending generally in a direction opposite to the direction of movement of said first clutch element from said opening to a location at which it engages said moving surface to intercept the leading edge of a copy sheet moving with said surface to strip a portion of said sheet away from said surface and to direct said portion into the space between said elements, the relationship between the thickness of said sheet and the space between said elements being such that entry of said sheet into said space clutches said elements to each other for movement as a unit, and means responsive to a predetermined movement of said elements as a unit for advancing said second element relative to said first element to release said portion of a copy sheet.

* * * * *